US008632428B2

(12) United States Patent
Burger

(10) Patent No.: US 8,632,428 B2
(45) Date of Patent: Jan. 21, 2014

(54) BALL BAT WITH INTERNAL IMPACT DAMPENING MEANS

(75) Inventor: George W. Burger, Rocklin, CA (US)

(73) Assignee: Hillerich & Bradsby Co., Louisville, KY (US)

( * ) Notice: Subject to any disclaimer, the term of this patent is extended or adjusted under 35 U.S.C. 154(b) by 355 days.

(21) Appl. No.: 12/928,756

(22) Filed: Dec. 17, 2010

(65) Prior Publication Data

US 2011/0152015 A1 Jun. 23, 2011

Related U.S. Application Data

(60) Provisional application No. 61/284,659, filed on Dec. 22, 2009.

(51) Int. Cl.
*A63B 59/06* (2006.01)

(52) U.S. Cl.
USPC ..... 473/566; 473/567

(58) Field of Classification Search
USPC ..... 473/457, 519, 520, 564–568
See application file for complete search history.

(56) References Cited

U.S. PATENT DOCUMENTS

| | | | | |
|---|---|---|---|---|
| 3,877,698 | A * | 4/1975 | Volpe | 473/520 |
| 3,963,239 | A * | 6/1976 | Fujii | 473/519 |
| 4,274,631 | A * | 6/1981 | Hayazaki | 473/457 |
| 4,951,948 | A | 8/1990 | Peng | |
| 5,094,453 | A * | 3/1992 | Douglas et al. | 473/566 |
| 5,511,777 | A | 4/1996 | McNeely | |
| 5,899,823 | A | 5/1999 | Eggiman | |
| 5,961,405 | A * | 10/1999 | MacKay, Jr. | 473/566 |
| 6,077,178 | A * | 6/2000 | Brandt | 473/520 |
| 6,176,795 | B1 * | 1/2001 | Schullstrom | 473/566 |
| 6,497,631 | B1 * | 12/2002 | Fritzke et al. | 473/566 |
| 6,612,945 | B1 | 9/2003 | Anderson | |
| 7,014,580 | B2 * | 3/2006 | Forsythe et al. | 473/566 |
| 7,147,580 | B2 * | 12/2006 | Nutter et al. | 473/457 |
| 7,344,461 | B2 | 3/2008 | Van Nguyen | |
| 7,867,114 | B2 * | 1/2011 | Sutherland et al. | 473/567 |
| 2001/0021678 | A1 * | 9/2001 | Pitsenberger et al. | 473/564 |
| 2002/0094892 | A1 * | 7/2002 | Chauvin et al. | 473/566 |
| 2004/0053716 | A1 * | 3/2004 | Wu | 473/564 |
| 2006/0025253 | A1 | 2/2006 | Giannetti et al. | |
| 2006/0258490 | A1 * | 11/2006 | Fitzgerald et al. | 473/564 |
| 2007/0254752 | A1 | 11/2007 | Sutherland et al. | |
| 2008/0070725 | A1 | 3/2008 | Davis | |

(Continued)

OTHER PUBLICATIONS

International Search Report, Form PCT/ISA/210, 3 pages, for International Application No. PCT/US10/03196 completed on Feb. 15, 2011 and mailed Mar. 4, 2011.

*Primary Examiner* — Mark Graham
(74) *Attorney, Agent, or Firm* — James C. Eaves, Jr.; Brian W. Chellgren; Bingham Greenebaum Doll LLP

(57) ABSTRACT

Industry regulatory organizations have created performance restrictions for ball bats. The present invention relates to a ball bat with an internal impact dampening means. More particularly, the present invention relates to a ball bat with a handle, a barrel, and a central tube positioned coaxially within the barrel. The central tube includes at least one restriction member capable of limiting the deformation experienced by the ball bat upon impact of a ball. Precisely limiting the deformation of the ball bat allows the present invention to achieve, but not exceed, performance substantially equal to the maximum performance allowed by industry regulatory organizations and maintain that level of performance over a substantial length of the ball bat.

21 Claims, 10 Drawing Sheets

(56) References Cited

U.S. PATENT DOCUMENTS

| | | | | |
|---|---|---|---|---|
| 2008/0070726 | A1* | 3/2008 | Watari et al. | 473/566 |
| 2008/0161140 | A1* | 7/2008 | Misono et al. | 473/568 |
| 2009/0143176 | A1 | 6/2009 | Burger | |
| 2009/0215559 | A1 | 8/2009 | McNamee et al. | |
| 2009/0280935 | A1 | 11/2009 | Watari et al. | |
| 2010/0087282 | A1 | 4/2010 | Smith | |
| 2010/0160095 | A1* | 6/2010 | Chauvin et al. | 473/564 |
| 2011/0059820 | A1* | 3/2011 | Burger | 473/564 |
| 2011/0111894 | A1* | 5/2011 | Thouin | 473/564 |
| 2011/0287877 | A1* | 11/2011 | Vander Pol et al. | 473/564 |

* cited by examiner

BALL BAT WITH INTERNAL IMPACT DAMPENING MEANS

This application claims the benefit of U.S. Provisional Patent Application Ser. No. 61/284,659, entitled BALL BAT WITH INTERNAL DAMPENING MEANS, filed Dec. 22, 2009 to George W. Burger and incorporated herein by reference.

BACKGROUND OF THE INVENTION (a) Field of the Invention

Industry regulatory organizations have created performance restrictions for ball bats. The present invention relates to a ball bat with an internal impact dampening means. More particularly, the present invention relates to a ball bat with a handle, a barrel, and a central tube positioned coaxially within the barrel. The central tube includes at least one restriction member capable of limiting the deformation experienced by the ball bat upon impact of a ball. Precisely limiting the deformation of the ball bat allows the present invention to achieve, but not exceed, performance substantially equal to the maximum performance allowed by industry regulatory organizations and maintain that level of performance over a substantial length of the ball bat.

(b) Description of the Prior Art

Baseball and softball are very popular sports in the United States, Japan, Cuba, and elsewhere. While ball bats have traditionally been made of wood, metallic and/or composite ball bats having generally cylindrical, hollow barrels have emerged in recent years.

The performance of a ball bat is related to the force imparted to a ball upon impact. In a collision between a ball and a bat, enormous energy is required to halt and reverse the direction of a fast moving ball in a fraction of a second. Upon impact, a portion of this kinetic energy is converted into temporary compression or deformation of the ball bat. Much of this stored energy is returned to the ball as it leaves the bat. This phenomenon is generally referred to as the "trampoline effect." The barrel of a ball bat has an optimal hitting area where the trampoline effect is maximized, referred to as the bat's "sweet spot."

One issue affecting high performance ball bats is the introduction of performance restrictions on ball bats by industry regulatory organizations governing organized play. Many of these organizations have imposed limits or restrictions on the maximum performance of ball bats. In particular, a need exists for a ball bat capable of achieving, but not exceeding, performance substantially equal to the maximum performance allowed by industry regulatory organizations and maintaining that level of performance over a substantial length of the ball bat.

SUMMARY OF THE INVENTION

It is an object of the present invention to provide a novel design for a ball bat capable of achieving, but not exceeding, performance substantially equal to the maximum performance allowed by industry regulatory organizations and maintaining that level of performance over a substantial length of the ball bat. The present invention achieves the objective by including at least one restriction member capable of limiting the deformation of the ball bat, thereby decreasing the trampoline effect.

The present invention relates to a ball bat including a central tube coaxially positioned within the barrel of the ball bat. The central tube is attached to the end cap of the ball bat. The central tube includes at least one restriction member capable of limiting the deformation of the ball bat upon impact. Preferably, each restriction member is a washer-shaped member positioned coaxially around the central tube with a diameter slightly less than the inner diameter of the ball bat barrel. Each restriction member is a resilient object capable of resisting deformation. When the ball bat impacts a ball, the ball bat barrel transiently deforms and the inner surface of the barrel may contact one or more of the at least one restriction member. The end cap flexes as the barrel deforms, allowing the central tube to move from a coaxial position in a direction opposite from the impact until the at least one restriction member contacts the inner surface of the barrel on a side opposite from the impact. The barrel then returns to its original, non-deformed shape, and the central tube returns to a coaxial position therein. The transient deformation of the barrel is limited by contact with one or more of the at least one non-deforming restriction member. Restricting the deformation of the barrel limits the trampoline effect, thus decreasing bat performance.

The present invention may be customized to conform to different performance restrictions or different play styles. For example, a comparatively large restriction member may be used in a baseball league with severe restrictions on bat performance. A comparatively small restriction member may be used in a baseball league which requires only a slight decrease in performance for high performance bats. A smaller restriction member allows for greater deformation of the ball bat before the restriction member is contacted, thereby causing a smaller effect on the performance of the ball bat. The effective diameter of a restriction member may be increased by using a larger restriction member or by disposing a resilient member about the outer diameter of the restriction member.

High performance bats with large sweet spots may include a plurality of restriction members. For example, a ball bat may have a large sweet spot wherein the center of the sweet spot has a performance significantly above the allowed level and the edge of the sweet spot has a performance only slightly above the allowed level. Such a bat may include a larger restriction member positioned at a longitudinal station equal to the center of the sweet spot and a smaller restriction member positioned at the edge of the sweet spot. By using a plurality of restriction members with different diameters along the barrel of a ball bat, the deformation of the ball bat may be selectively limited. The present invention provides selective control over the deformation of a ball bat, thus controlling the trampoline effect and allowing fine control over the performance of a ball bat.

In one embodiment, the present invention is a ball bat comprising: a hollow barrel having an inner diameter; a central tube extending along a longitudinal axis, the central tube located coaxially within the barrel; and at least one restriction member positioned transverse to the longitudinal axis, the central tube extending through the at least one restriction member; whereby deformation of the barrel can be limited by the barrel coming into contact with at least one of the at least one restriction member.

In another embodiment, the present invention is a ball bat comprising: a hollow composite barrel having an inner diameter; a central tube extending along a longitudinal axis, the central tube having an end and being located coaxially within the barrel; at least one restriction member positioned transverse to the longitudinal axis, the central tube extending through the at least one restriction member; a generally cylindrical support including a support central channel, whereby the central tube extends at least partially through the support central channel; and an end cap including a central ring, the end cap positioned on an end of the barrel, the end of the central tube positioned within the central ring; whereby deformation of the barrel can be limited by the barrel coming into contact with at least one of the at least one restriction member.

In a further embodiment, the present invention is a method for making a ball bat comprising the steps of: (a.) providing a hollow barrel; (b.) providing a central tube extending along a longitudinal axis, the central tube sized to fit within the barrel without contacting the barrel; (c.) providing at least one restriction member including a restriction member central channel; (d.) providing a support, the support including a support central channel; (e.) serially positioning the central tube within the restriction member central channel and at least partially within the support central channel; and (f.) positioning the central tube coaxially within the barrel, whereby deformation of the barrel can be limited by the barrel coming into contact with at least one of the at least one restriction member.

In another embodiment, the present invention is a method of impacting a ball with a ball bat with reduced performance comprising the steps of: (a.) providing a ball bat comprising: (1.) a hollow barrel with an inner surface; (2.) a central tube positioned coaxially within the hollow barrel, and sized to fit within the barrel without contacting the barrel; (3.) at least one restriction member positioned transverse to the longitudinal axis, the central tube extending through the at least one restriction member; (4.) a void located between the at least one restriction member and the inner surface; and (b.) impacting a ball with the ball bat barrel, wherein the impact causes the ball bat barrel to transiently deform, causing the central tube to move from the coaxial position in a direction opposite from the impact until at least one of the at least one restriction member contacts the inner surface of the barrel on the side opposite from the impact, the central tube then returning to the coaxial position.

BRIEF DESCRIPTION OF THE DRAWINGS

A better understanding of the present invention will be had upon reference to the following description in conjunction with the accompanying drawings, wherein.

DETAILED DESCRIPTION OF THE PREFERRED EMBODIMENT

Figure 1:
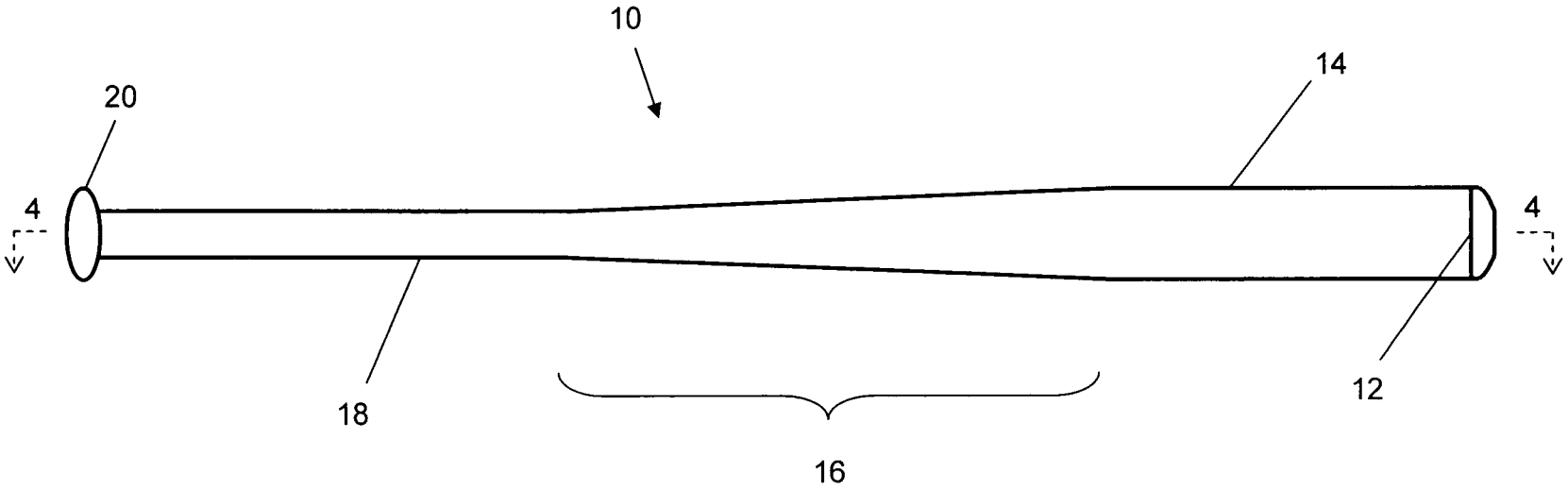
FIG. 1 depicts a ball bat.

With reference to FIG. 1, an embodiment of the ball bat 10 of the present invention is shown having an end cap 12, a barrel 14, a transition region 16, a handle 18, and a knob 20. The barrel 14 is a hollow tube and, in one embodiment, has an inner diameter of about 2.0 inches (5.08 cm).

Figure 2B:
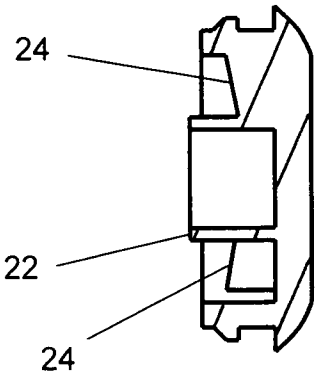
FIG. 2A-2B depict a top interior view and a cross-sectional view along lines 2-2 of an end cap.
Figure 2A:
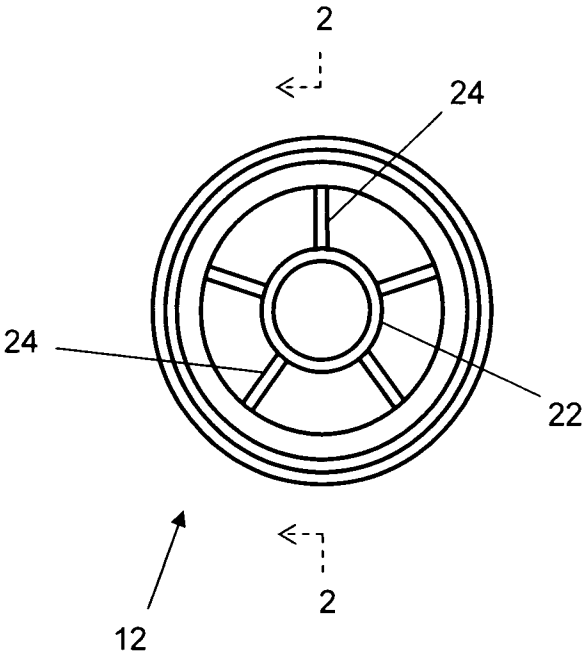

As shown in FIGS. 2A-B, the end cap 12 includes a central ring 22 stabilized by a plurality of ribs 24. In one embodiment, the central ring 22 has an inside diameter of about 0.625 inches (1.59 cm). The end cap 12 may be secured to the barrel 14 by any suitable method, such as, for example, bonding with an adhesive, a friction fit, or a mechanical lock where an end cap ridge and corresponding barrel channel, or vice versa, secure the end cap 12 via mechanical interference. The end cap 12 may be manufactured using common manufacturing techniques, as known in the art.

Figure 3B:
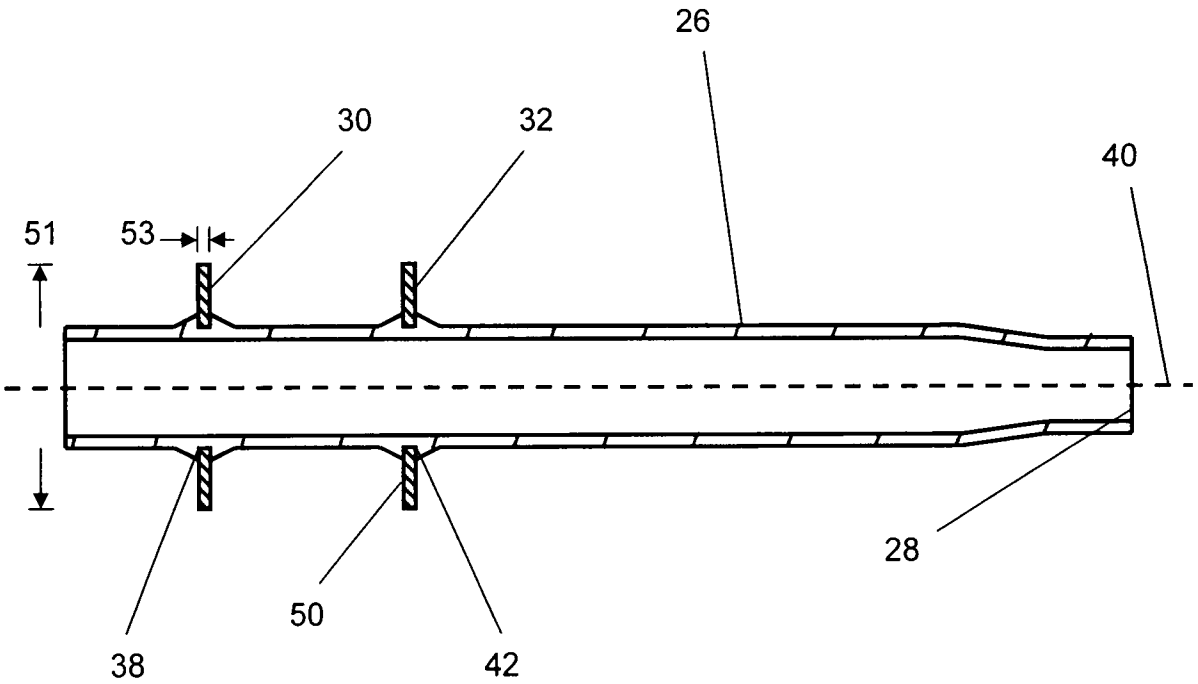
FIG. 3A-3B depict a knob-end view and a cross-sectional view along lines 3-3 of a central tube with two restriction members.
Figure 4:
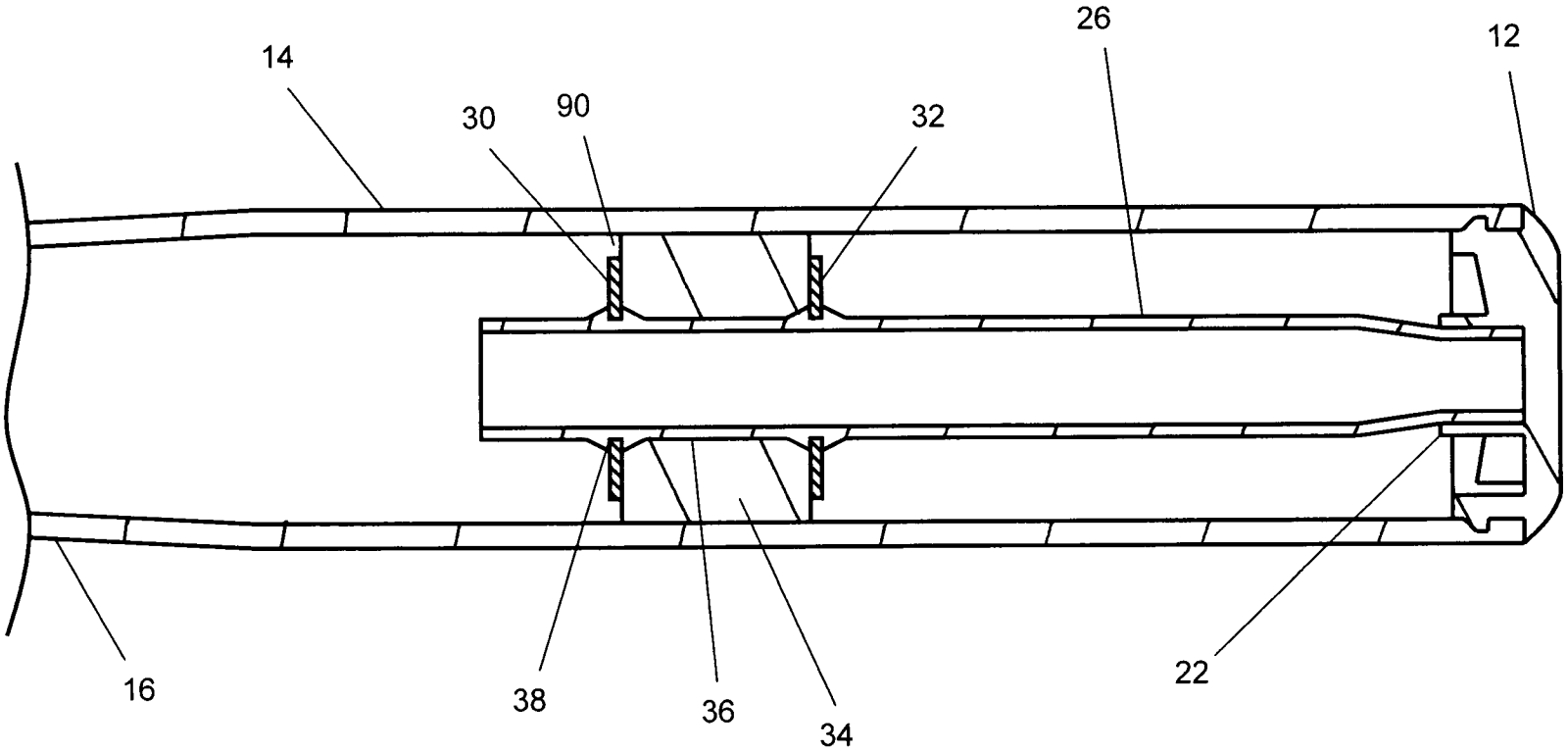
FIG. 4 depicts a cross-sectional view of the barrel of an embodiment of the ball bat of the present invention along lines 4-4 of FIG. 1.
Figure 6:
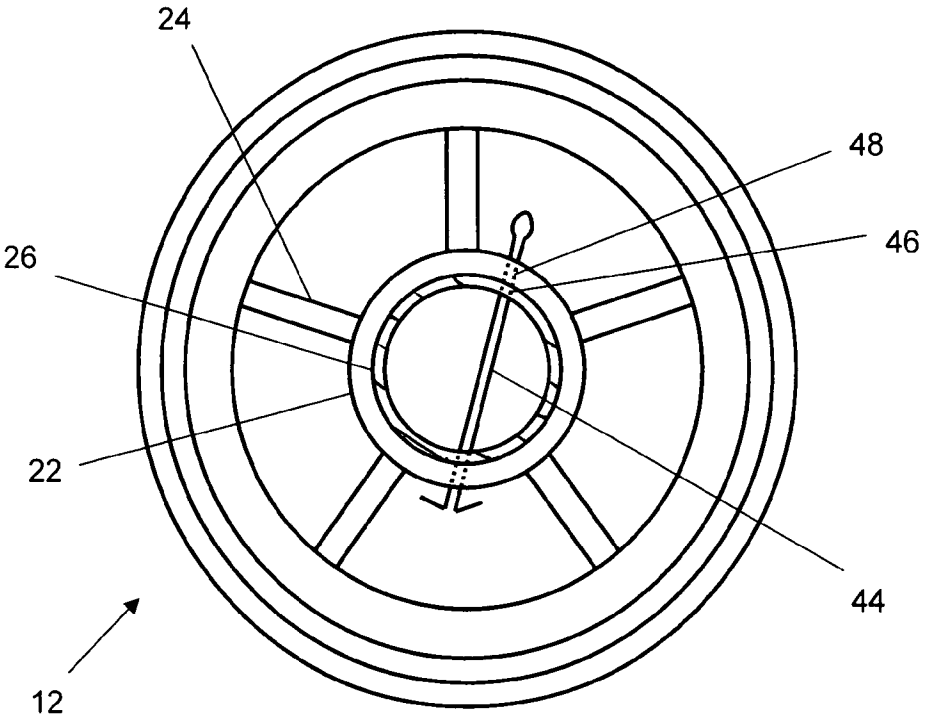
FIG. 6 depicts a top interior cross-sectional view of an end cap and central tube mechanically locked with a split pin along lines 6-6 of FIG. 5.

With reference to FIGS. 3B, 4, and 6, the ball bat includes a central tube 26 coaxially positioned within the barrel 14. The central tube 26 extends along a longitudinal axis 40 and includes an end 28 sized to snugly fit within the central ring 22. The end 28 may be retained within the central ring 22 by any suitable means, such as, for example by bonding with an adhesive and with a pin 44. In one embodiment, as shown in FIG. 6, corresponding central tube holes 46 and central ring holes 48 are formed, such that a split pin 44 may be inserted through the holes 46, 48, mechanically locking the end 28 within the central ring 22.

Figure 3A:
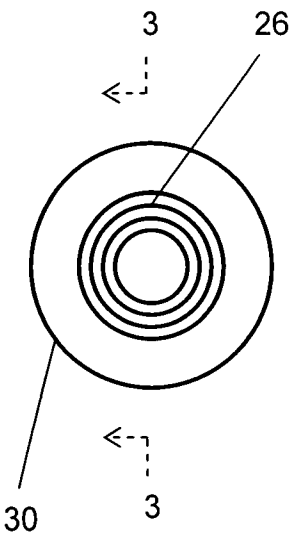

The central tube 26 may be constant diameter or variable diameter. In one embodiment, as shown in FIG. 3, the end 28 has an outer diameter of about 0.625 inches (1.59 cm), remaining constant for a length of about 0.755 inches (1.92 cm). The diameter of the central tube 26 then increases over a length of about 0.47 inches (1.19 cm) to a diameter of about 0.875 inches (2.22 cm), which remains generally constant for a length of 5.9 inches (15.0 cm). The total length of the central tube 26 is about 7.125 inches (18.1 cm). The central tube 26 may be made of any suitable material, such as, for example, composite fiber.

The central tube 26 includes at least one restriction member 50 capable of limiting the deformation experienced by the ball bat 10 upon impact of a ball. The at least one restriction member 50 is a generally washer-shaped member with a restriction member central channel 42. The at least one restriction member 50 is positioned coaxially around the central tube 26, with the central tube 26 positioned within the restriction member central channel 42 of the at least one restriction member 50. The outer diameter of the at least one restriction member 50 is less than the inner diameter of the barrel 14, creating a void 90 between the at least one restriction member 50 and the inner surface of the barrel 14. In the embodiments shown in FIGS. 4 and 5, the outer diameter of the at least one restriction member 50 may be 75-95% the inner diameter of the barrel 14 or, preferably, 85-92% the inner diameter of the barrel 14. The at least one restriction member 50 is composed of a resilient material capable of resisting deformation, such as aluminum or pre-impregnated composite fiber ("pre-preg"). In a preferred embodiment, the at least one restriction member 50 is composed of 7075 aluminum or laminated graphite pre-preg.

In one embodiment, as shown in FIG. 3, the central tube 26 includes a first restriction member 30. In this embodiment, the first restriction member 30 has an outer diameter 51 of about 1.75 inches (4.45 cm), 87.5% the inner diameter of the barrel 14, and a length 53 of about 0.11 inches (2.8 mm). The first restriction member 30 is located along the length of the central tube 26 at about the same longitudinal station as the center of the optimal hitting area or "sweet spot" of the ball bat 10. In this embodiment, the first restriction member 30 is located about 6.5 inches (16.5 cm) from the end of the ball bat 10.

In this embodiment, the central tube 26 further includes a second restriction member 32. The second restriction member 32 has an outer diameter of about 1.70 inches (4.32 cm), 85% the inner diameter of the barrel 14, and a length of about 0.11 inches (2.8 mm). The second restriction member 32 is located along the length of the central tube 26 at a position between the first restriction member 30 and the end cap 12. In this embodiment, the second restriction member 32 is located about 5.0 inches (12.7 cm) from the end of the ball bat 10.

In other embodiments, the central tube 26 may include a single restriction member, two, three, or more restriction members. The maximum performance of a ball bat 10 may be precisely controlled by varying the number of restriction members and the diameter, length, and location of each.

The ball bat 10 preferably includes a support 34, as shown in FIG. 4. The support 34 is generally cylindrical and sized to snugly fit within the barrel 14. The support 34 includes a support central channel 36 sized to snugly accept the central tube 26. In one embodiment, the support 34 has a diameter of about 2.0 inches (5.08 cm) and the support central channel 36 has a diameter of about 0.875 inches (2.22 cm) and snugly accepts the 0.875 inch (2.22 cm) diameter section of the central tube 26.

Figure 5:
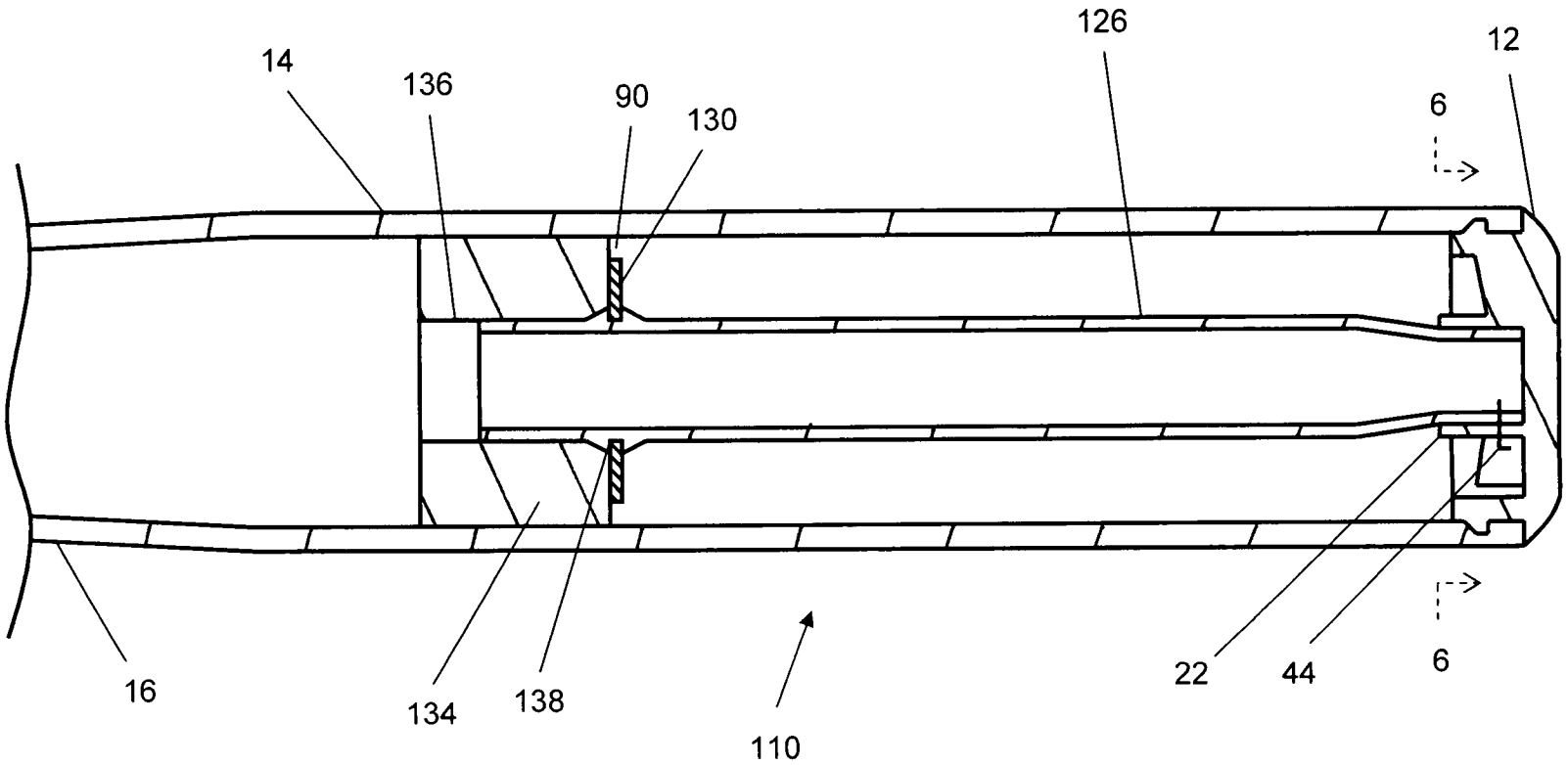
FIG. 5 depicts a cross-sectional view of the barrel of a second embodiment of the ball bat of the present invention along lines 4-4 of FIG. 1.

The central tube 26 extends at least partially through the support central channel 36. Preferably, the support 34 is placed coaxially around the central tube 26 at a longitudinal station where the support 34 contacts at least one restriction member 50. In an embodiment with a first restriction member 30 and second restriction member 32, the support 34 is preferably placed coaxially around the central tube 26 between the first restriction member 30 and second restriction member 32, as shown in FIG. 4. Preferably, the support is of sufficient length to contact both the first restriction member 30 and second restriction member 32. In an embodiment where the first restriction member 30 is located about 6.5 inches (16.5 cm) from the end of the ball bat 10 and the second restriction member is located about 5.0 inches (12.7 cm) from the end of the ball bat 10, the support 34 has a length of about 1.39 inches (3.53 cm), which places the support 34 in contact with both the 0.11 inch (2.8 mm) long restriction members. In an embodiment with a third or more restriction members, the present invention preferably includes additional supports 34 positioned between each pair of restriction members. In an embodiment with a single restriction member, as shown in FIG. 5, the support is preferably placed coaxially around the central tube 26 on a side of the restriction member opposite the end cap 12, such that the central tube 26 extends partially through the support central channel 36.

The support 34 may be made of any suitable material, such as, for example, foam, or preferably, expanded polyproplyene ("EPP") foam with a density between 1.0 and 2.0 lb/cu. ft. (16.0-32.0 g/l), ideally about 1.3 lb/cu. ft (20.8 g/l). By contacting at least one restriction member 50, the support 34 serves to dampen any vibration of the at least one restriction member 50 and the central tube 26 that occurs as a result of an impact between the ball bat 10 and a ball.

For example purposes only, a central tube 26 may be made by rolling at least one flat sheet of pre-preg around an appropriately shaped mandrel, thereby making a variable diameter tube as described above. In a preferred embodiment, the sheet of pre-preg comprises six layers of graphite pre-preg with fibers angled +/−20 degrees from the longitudinal with each layer orientated at a negative angle to the previous layer. Each layer has a height of about 0.005 inches (0.127 mm), providing a central tube 26 with a thickness of about 0.03 inches (0.76 mm).

At least one restriction member 50 is positioned on the central tube 26 at the appropriate longitudinal station. The central tube 26 is then placed in a mold conforming to the shape of the central tube 26 including the at least one restriction member 50. The mold includes at least one pair of hollows where excess composite fiber may be added. For each pair of hollows, one hollow is located adjacent to and on the end cap 12 side of a restriction member 50 and the other hollow is located adjacent to and on the knob 20 end side of the same restriction member 50. Upon curing, the excess composite fiber in each hollow forms a protrusion on the central tube 26 extending perpendicular to the longitudinal axis 40 of the central tube 26. Each protrusion has a height of about 0.11 inches (2.8 mm). Each pair of protrusions creates and defines a groove 38 extending perpendicular to the longitudinal axis 40 of the central tube 26. Each groove 38 is sized such that it may secure and retain a restriction member 50 by mechanical interference. In one embodiment, each groove 38 has a length of about 0.11 inches (2.8 mm). In an embodiment including a plurality of restriction members, as shown in FIGS. 3B and 4, the central tube 26 includes a plurality of grooves 38, whereby each groove 38 accepts and secures one restriction member 50 at the desired longitudinal station.

After curing, the central tube 26 is positioned within the support central channel 36. In a preferred embodiment, a slit is introduced into the support 34, such that the support 34 may be opened in a clamshell fashion to receive the central tube 26.

The handle 18 is a mostly constant diameter hollow tube. The handle 18 may be manufactured using common manufacturing techniques.

For example purposes only, a composite handle 18 may be made by rolling at least one flat sheet of pre-preg around a mandrel, thereby making a tube with an outer diameter appropriately sized for a ball bat handle. In a preferred embodiment, the sheet of pre-preg comprises two layers of graphite pre-preg with fibers angled +/−15 degrees from the longitudinal with one layer orientated at a negative angle to the other layer. Two layers of pre-preg with a height of about 0.005 inches (0.127 mm) and fibers angled 90 degrees from the longitudinal are wrapped around the last 7.87 inches (20.0 cm) of the handle 18 at the end opposite the knob 22.

The barrel 14 is a mostly constant diameter hollow tube that tapers through a transition region 16 to the handle 18. In one embodiment, the barrel 14 is made of composite material. The composite barrel 14 may be manufactured using common manufacturing techniques.

For example purposes only, a composite barrel 14 may be manufactured by spirally rolling 24 layers of high aspect ratio parallelogram-shaped pieces of pre-preg, each layer having a height of about 0.005 inches (0.127 mm), on a rolling mandrel with the fibers oriented longitudinally, thereby making a tube with an outer diameter appropriately sized for a ball bat barrel. The parallelograms are rolled up such that each layer has a butt joint with itself and such that on one end all the layers stop at the same longitudinal station but on the other end, each layer is about 2.54 inches (1.0 cm) shorter than the previous layer, creating a tapered end. In one embodiment, the layers are angled +/−37 degrees from the longitudinal with each layer orientated at a negative angle to the previous layer.

After being rolled up, a tapered mandrel is added to one end of the rolling mandrel immediately after where the lay-up ends on the tapered end. Rubber bands are placed around the lay-up on this end, then the entire assembly is partially slid off the rolling mandrel and onto the tapered mandrel, forming a tapered transition region 16. In one embodiment, the transition region 16 is about 8.0 inches (20.3 cm) in length.

The barrel 14 is removed from the mandrels and a portion of the handle 18 is inserted. An inflatable bladder is inserted into the ball bat 10 assembly and a standard knob 20 is applied using techniques common in the industry. The bladder is inflated, expanding the barrel 14 and handle 18. The assembly then is placed into a ball bat-shaped mold under pressure and heated to cure the ball bat, using standard techniques known in the art. After curing, the end cap 12 and central tube 26 are inserted into the ball bat 10.

FIG. 5 depicts a second embodiment of the ball bat 110 of the present invention wherein the at least one restriction member 50 is a single restriction member 130. In this embodiment, the single restriction member 130 has a diameter of about 1.75 inches (4.45 cm) and a length of about 0.11 inches (2.8 mm). The single restriction member 130 is located along the length of the central tube 26 at about the same longitudinal station as the center of the optimal hitting area or "sweet spot" of the ball bat 10, about 6.5 inches (16.5 cm) from the end of the ball bat 10. In this embodiment, the central tube 126 includes a single groove 138 which secures and retains the single restriction member 130. The support 134 is preferably positioned around the central tube 126 on a side of the single restriction member 130 opposite the end cap 12. In this embodiment, the 1.39 inch (3.53 cm) long support 134 will extend past the central tube 26, as shown in FIG. 5. In alternative embodiments, a shorter support 134 may be used such that the support 134 does not extend past the central tube 26.

Figure 9B:
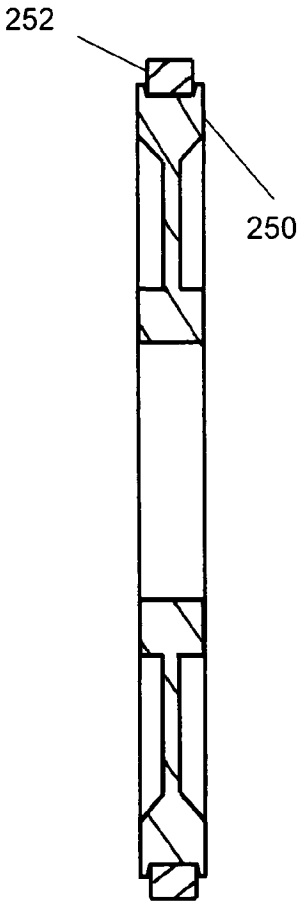
FIG. 9A-B depict a side view and a cross sectional view along lines 9-9 of the restriction member resilient member of the third embodiment of the ball bat of the present invention including the resilient member.
Figure 9A:
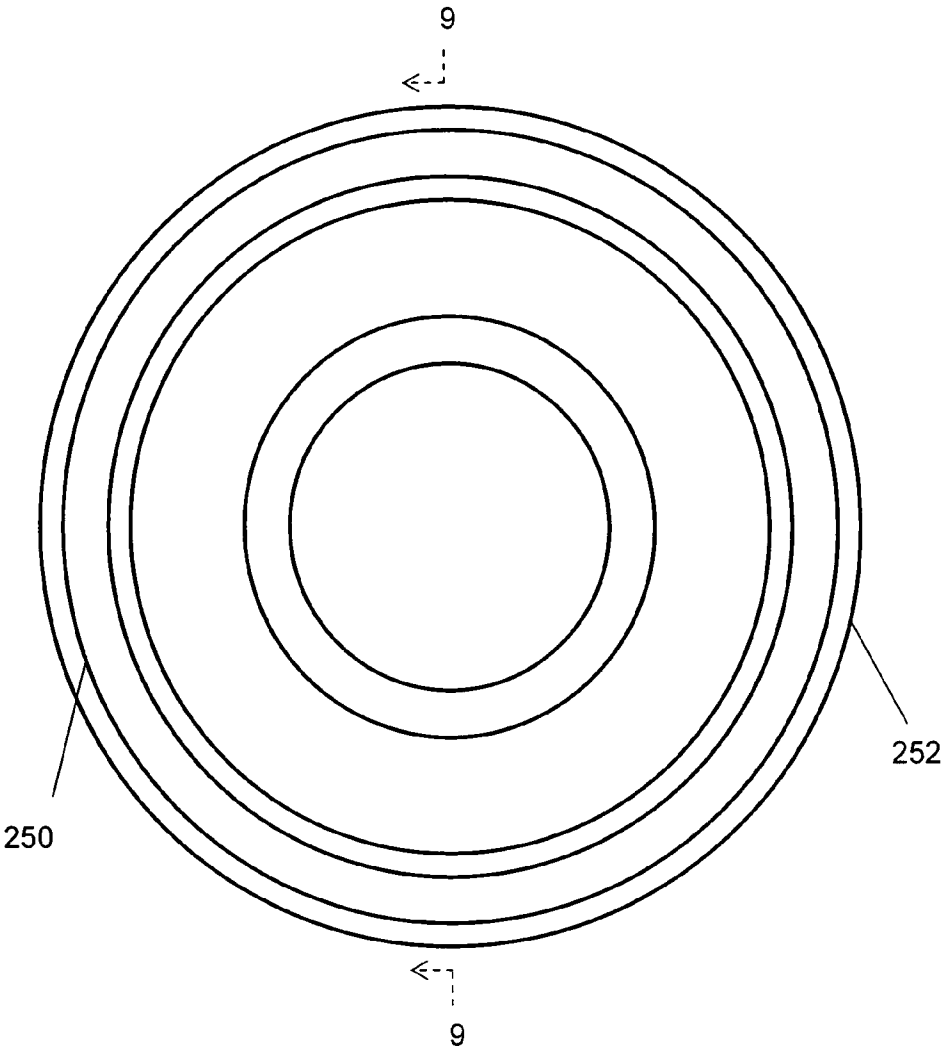

In a third embodiment of the present invention, as shown in FIGS. 7A-B, 8A-B, 9A-B, and 10, a ball bat 210 may include at least one resilient member 252 disposed about at least one of the at least one restriction member 250. As previously discussed, when the ball bat 210 impacts a ball, the barrel 214 transiently deforms until the inner surface of the barrel 214 contacts the at least one restriction member 250. The resilient member 252 increases the effective diameter of the at least one restriction member 250, which provides a smaller void 290 between the at least one restriction member 250 and the inner surface of the barrel 214, which can further limit the performance of the ball bat 210. Use of at least one resilient member 252 has also been found to affect the sound upon impact between a ball and the ball bat 210. In one embodiment, the at least one resilient member 252 is a rubber ring encircling or otherwise disposed about the at least one restriction member 250, as shown in FIGS. 9A-B. In a preferred embodiment, the resilient member 252 is a rubber ring with a hardness of about 90-95 Shore A. In embodiments including a plurality of restriction members 250, resilient members 252 may be disposed about none, less than all, or all of the plurality of restriction members 250.

Figures 7A, 7B:
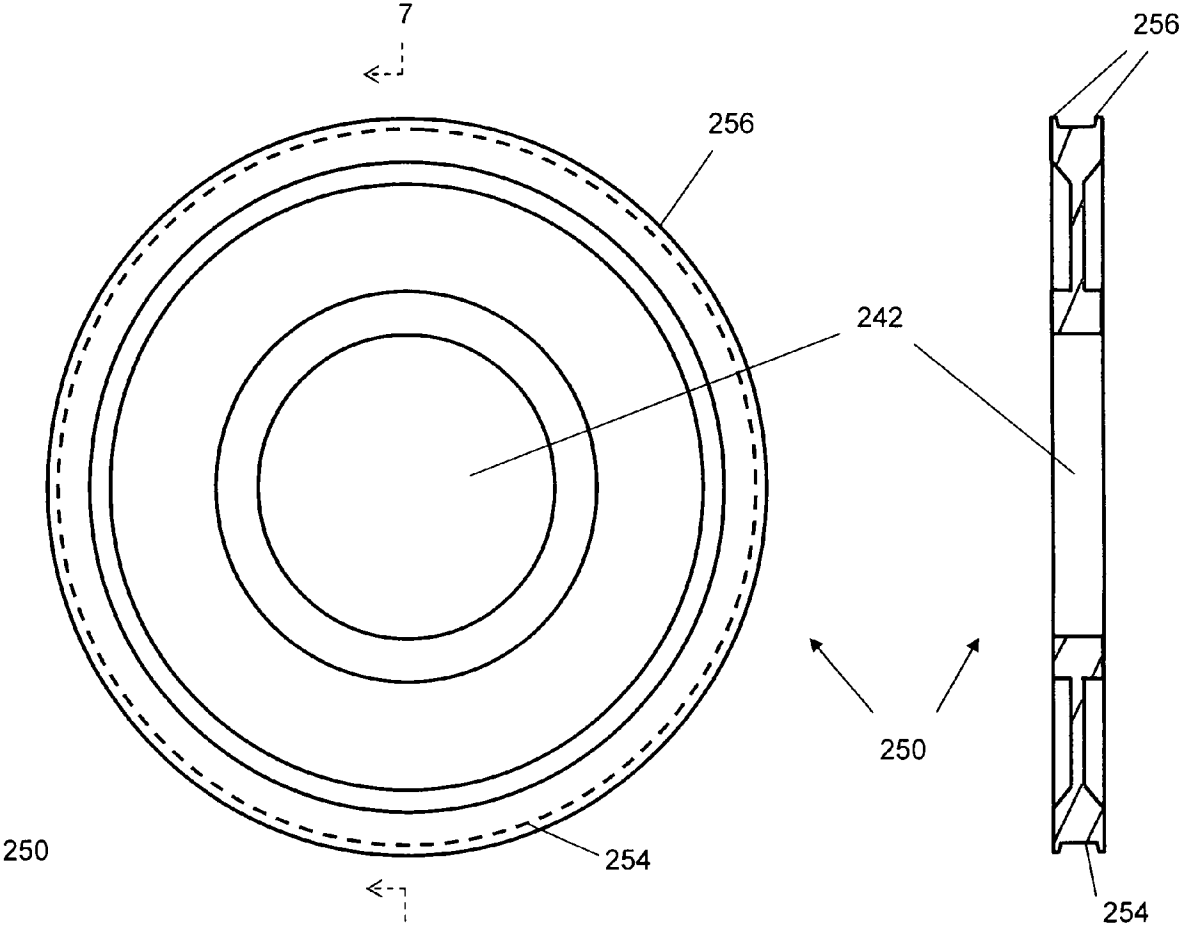
FIG. 7A-B depict a side view and a cross sectional view along lines 7-7 of the restriction member of a third embodiment of the ball bat of the present invention.
Figures 8A, 8B:
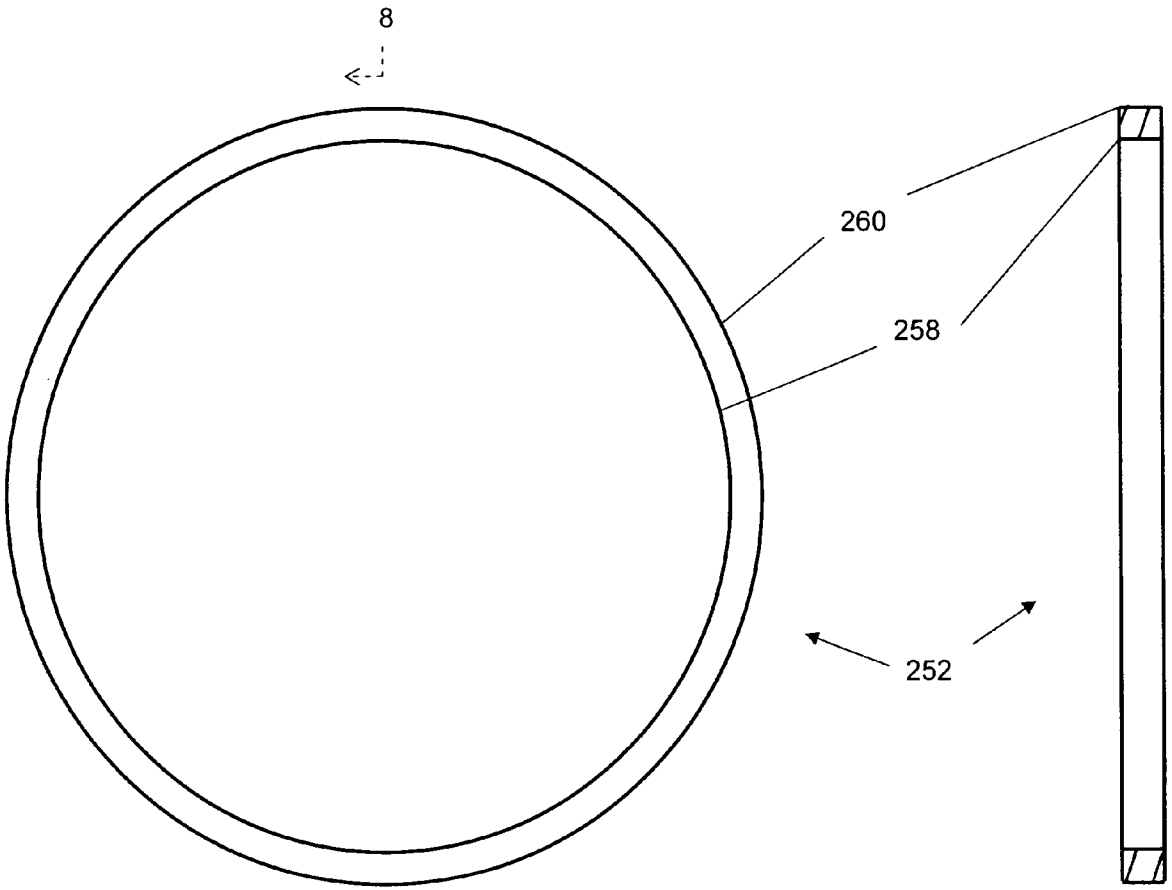
FIG. 8A-B depict a side view and a cross sectional view along lines 8-8 of the resilient member of the third embodiment of the ball bat of the present invention.

Referring now to FIGS. 7A-B, the at least one restriction member 250 of the third embodiment is preferably shaped to retain the resilient member 252 about the at least one restriction member 250. In one embodiment, where the inner diameter of the barrel 214 is 2.28 inches (5.79 cm), the at least one restriction member has a diameter of about 2.124 inches (5.38 cm) and includes a restriction member central channel 242 with a diameter of about 0.875 inches (2.22 cm). The at least one restriction member 250, at a position adjacent of the restriction member central channel 242, has a length of about 0.3 inches (7.6 mm) and maintains this length from a diameter 0.875 inches (2.22 cm) to about 1.148 inches (2.92 cm). The length of the at least one restriction member 250 is about 0.08 inches (2.0 mm) from a diameter of about 1.148 inches (2.92 cm) to about 1.752 inches (4.45 cm). The length of the at least one restriction member 250 increases at about a 45 degree angle from 0.08 inches (2.0 mm) to 0.3 inches (7.6 mm) as the diameter increases from about 1.752 inches (4.45 cm) to about 1.86 inches (4.72 cm). The at least one restriction member 250 maintains the length to a diameter of about 2.114 inches (5.37 cm), then, on either end of its length, decreases on a curve with a radius of 0.01 inches (0.25 mm) to a maximum diameter of 2.124 inches (5.38 cm). The diameter of the at last one restriction member 250 then decreases at about a 15 degree angle to a diameter of 2.07 inches (5.26 cm), forming a restriction member groove 254 about 0.25 inches (6.4 mm) in length bounded by a pair of projections 256. Other designs for shaping the at least one restriction member 250 to retain the at least one resilient member will be apparent to individuals skilled in the art.

The resilient member 252 in this embodiment has a inner diameter 258 of about 2.07 inches (5.26 cm) and an outer diameter 260 of about 2.25 inches (5.72). The resilient member 252 is sized to fit within the restriction member groove 254 and preferably includes a length about equal to or less than the length of the restriction member groove 254. As shown in FIGS. 9A and 9B, the resilient member 252 encircles the at least one restriction member 250, and is retained within the restriction member groove 254 by the projections 256. In this embodiment, where the inner diameter of the ball bat is 2.28 inches (5.79 cm), there is a 0.03 inch (0.76 mm) void 290 between the resilient member 252. The outer diameter 260 of the resilient member 252 may 90-99.5% the inner diameter of the barrel 214, or preferably 94-99% the inner diameter of the barrel 214. In this particular embodiment, the outer diameter 260 of the resilient member 252 is 98.7% the inner diameter of the barrel 214 and the length of the resilient member is about 0.236 inches (6.0 mm).

Figure 10:
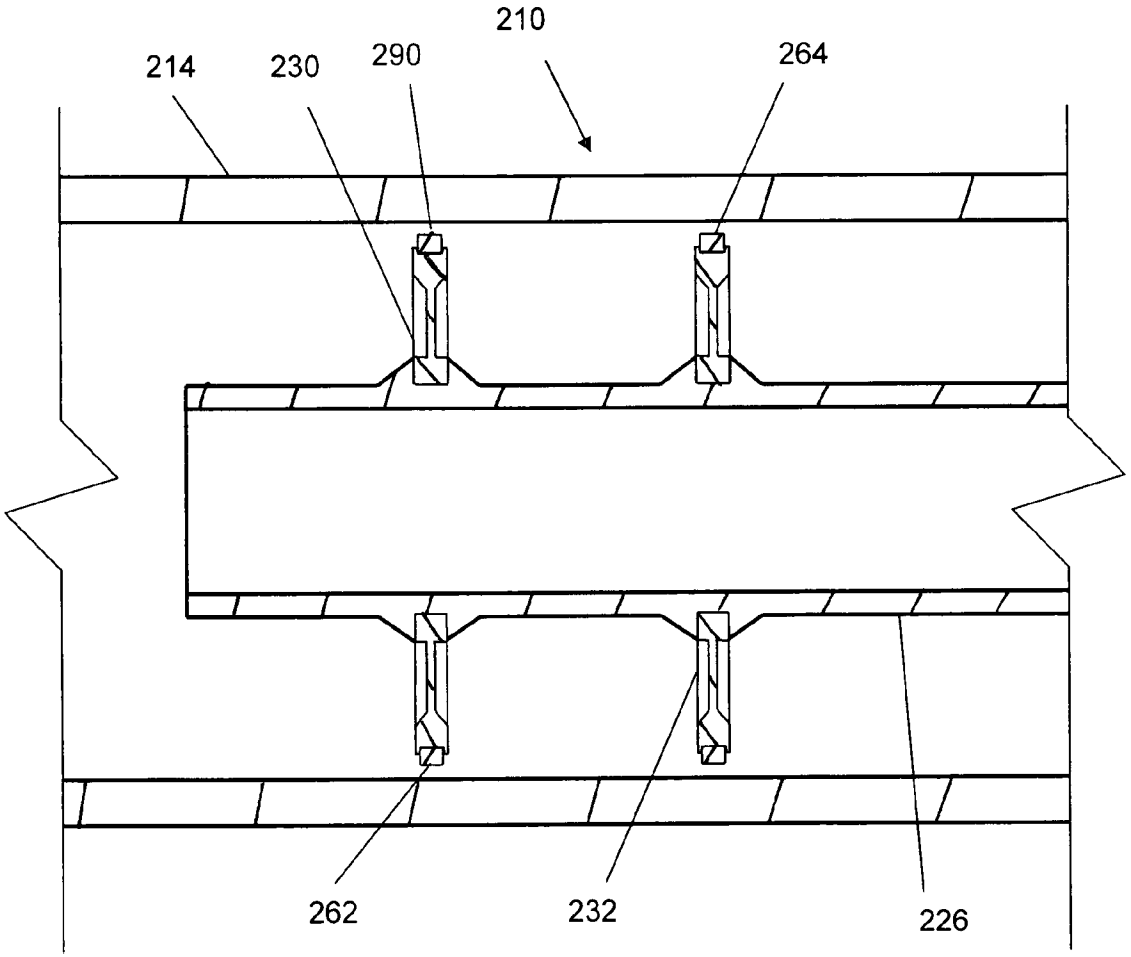
FIG. 10 depicts a cross-sectional view of the barrel of the third embodiment of the ball bat of the present invention along lines 4-4 of FIG. 1.

In the third embodiment, as shown in FIG. 10, the central tube 226 includes a first restriction member 230. In this embodiment, the inner diameter of the barrel 214 is 2.28 inches (5.79 cm) and the total length of the ball bat 210 is 32 inches (81.3 cm). In this embodiment, the first restriction member 230 has a diameter of about 2.03 inches (5.16 cm) to the surface of the restriction member groove 254, and a diameter of about 2.08 inches (5.28 cm) to the tips of the projections 256. A first resilient member 262 is disposed about the first restriction member 230 in the restriction member groove 254, and has an outer diameter 260 of about 2.21 inches (5.61 cm). The second restriction member 232 has a length of about 0.3 inches (7.6 mm). The first restriction member 230 is located along the length of the central tube 26 at about the same longitudinal station as the center of the optimal hitting area or "sweet spot" of the ball bat 210. In this embodiment, the first restriction member 230 is located about 6.75 inches (17.1 cm) from the end of the ball bat 210.

In this embodiment, the central tube 226 further includes a second restriction member 232. The second restriction member 232 has a diameter of about 2.07 inches (5.26 cm) to the surface of the groove 254, and a diameter of about 2.12 inches (5.38 cm) to the tips of the projections 256. A second resilient member 264 is disposed about the second restriction member 232 in the restriction member groove 254, and has an outer diameter 260 of about 2.25 inches (5.72 cm). The second restriction member 232 has a maximum length of about 0.3 inches (7.6 mm). The second restriction member 232 is located along the length of the central tube 26 at a position between the first restriction member 230 and the end cap 12. In this embodiment, the second restriction member 232 is located about 5.25 inches (13.3 cm) from the end of the ball bat 210.

The foregoing detailed description is given primarily for clearness of understanding and no unnecessary limitations are to be understood therefrom for modifications can be made by those skilled in the art upon reading this disclosure and may be made without departing from the spirit of the invention.

What is claimed is:

1. A ball bat comprising:

a hollow barrel having an inner diameter;

a handle;

a transition region connecting said barrel and said handle;

a central tube extending along a longitudinal axis, said central tube located coaxially within said barrel; and at least one generally washer-shaped restriction member positioned transverse to said longitudinal axis, said at least one restriction member including a restriction member central channel and an outer diameter, said central tube extending through said restriction member central channel;

whereby deformation of said barrel can be limited by the barrel coming into contact with at least one of said at least one restriction member; and wherein said central tube does not extend into said handle.

2. The ball bat of claim 1, wherein said outer diameter of said at least one restriction member is 75-95% said inner diameter of said barrel.

3. The ball bat of claim 2, wherein said outer diameter of said at least one restriction member is 85-92% said inner diameter of said barrel.

4. The ball bat of claim 1, wherein said at least one restriction member is composed of a resilient material capable of resisting deformation.

5. The ball bat of claim 4, wherein said at least one restriction member is composed of aluminum.

6. The ball bat of claim 4, wherein said at least one restriction member is composed of pre-impregnated composite fiber.

7. The ball bat of claim 1, further comprising a generally cylindrical support having a support central channel, whereby said central tube extends at least partially through said support central channel.

8. The ball bat of claim 1, further comprising an end cap positioned on an end of said barrel, said end cap having a central ring, and wherein said central tube includes an end, whereby said end of said central tube is positioned within said central ring.

9. The ball bat of claim 1, wherein said at least one restriction member is two generally washer-shaped restriction members positioned coaxially around said central tube.

10. The ball bat of claim 1, wherein said barrel includes an optimal hitting area and wherein at least one of said at least one restriction member is positioned within said barrel at said optimal hitting area.

11. The ball bat of claim 1, further comprising a void between said at least one restriction member and said barrel.

12. The ball bat of claim 1, further comprising a resilient member disposed about at least one of said at least one restriction member.

13. The ball bat of claim 12, wherein said at least one of said at least one restriction member is shaped to retain said resilient member.

14. The ball bat of claim 12, further comprising a void between said at least one resilient member and said barrel.

15. The ball bat of claim 14, wherein said at least one resilient member includes a diameter 90-99.5% said inner diameter of said barrel.

16. The ball bat of claim 9, further comprising a generally cylindrical support positioned coaxially around said central tube and positioned between said two restriction members.

17. A method for making a ball bat comprising the steps of:

a. providing a hollow barrel, a handle, and a transition region connecting said barrel and said handle;

b. providing a central tube extending along a longitudinal axis, said central tube sized to fit within said barrel without contacting said barrel and without extending into said handle;

c. providing at least one generally washer-shaped restriction member including a restriction member central channel;

d. providing a support, said support sized to snugly fit within said barrel and including a support central channel;

e. serially positioning said central tube within said restriction member central channel and at least partially within said support central channel; and f. positioning said central tube coaxially within said barrel, whereby deformation of said barrel can be limited by said barrel coming into contact with at least one of said at least one restriction member.

18. The method for making a ball bat of claim 17, further comprising the additional steps of:

g. providing an end cap, said end cap including a central ring;

h. inserting an end of said central tube in said central ring.

19. The method for making a ball bat of claim 17, wherein step c further comprises disposing at least one resilient member about at least one of said at least one restriction member.

20. A ball bat comprising:

a hollow barrel having an inner diameter;

a central tube extending along a longitudinal axis, said central tube located coaxially within said barrel; and at least one restriction member positioned transverse to said longitudinal axis, said central tube extending through said at least one restriction member;

whereby deformation of said barrel can be limited by the barrel coming into contact with at least one of said at least one restriction member;

wherein said central tube includes at least one groove extending perpendicular to the longitudinal axis; and wherein one of said at least one restriction member is positioned within each of said at least one groove.

21. A method for making a ball bat comprising the steps of:

a. providing a hollow barrel;

b. providing a central tube extending along a longitudinal axis, said central tube sized to fit within said barrel without contacting said barrel;

c. creating at least one groove in said central tube, said at least one groove extending perpendicular to said longitudinal axis;

d. providing at least one restriction member including a restriction member central channel;

e. providing a support, said support including a support central channel;

f. serially positioning said central tube within said restriction member central channel and at least partially within said support central channel, such that each of said at least one restriction member is positioned within one of said at least one groove; and g. positioning said central tube coaxially within said barrel, whereby deformation of said barrel can be limited by said barrel coming into contact with at least one of said at least one restriction member.

* * * * *